US008196328B2

(12) United States Patent
Simpkins

(10) Patent No.: US 8,196,328 B2
(45) Date of Patent: Jun. 12, 2012

(54) COMPACT FOLDABLE FIREARM WITH SURVIVAL TOOLS

(76) Inventor: Ronald D. Simpkins, Damascus, OR (US)

( * ) Notice: Subject to any disclaimer, the term of this patent is extended or adjusted under 35 U.S.C. 154(b) by 107 days.

(21) Appl. No.: 12/796,754

(22) Filed: Jun. 9, 2010

(65) Prior Publication Data

US 2011/0072705 A1 Mar. 31, 2011

Related U.S. Application Data

(60) Provisional application No. 61/185,920, filed on Jun. 10, 2009.

(51) Int. Cl.
*F41C 23/00* (2006.01)

(52) U.S. Cl. ..... 42/73; 42/71.01; 42/72; 42/75.01; 42/114

(58) Field of Classification Search ..... 42/71.01, 42/72, 75.01

See application file for complete search history.

(56) References Cited

U.S. PATENT DOCUMENTS

| | | | | |
|---|---|---|---|---|
| 36,571 | A | 9/1862 | Moses | |
| 1,059,405 | A * | 4/1913 | Sprague | 42/8 |
| 1,454,454 | A * | 5/1923 | Rosier | 42/59 |
| 3,995,376 | A * | 12/1976 | Kimble et al. | 434/22 |
| 4,271,623 | A * | 6/1981 | Beretta | 42/72 |
| 4,625,621 | A * | 12/1986 | Warin | 89/197 |
| 4,689,908 | A * | 9/1987 | McClellan | 42/71.02 |
| 4,774,929 | A | 10/1988 | Milliman | |
| 5,165,383 | A | 11/1992 | Ebert et al. | |
| 5,253,443 | A | 10/1993 | Bailkrich | |
| 5,305,539 | A | 4/1994 | Von Kuster | |
| 5,351,429 | A | 10/1994 | Ford | |
| 5,404,863 | A | 4/1995 | Poor | |
| 5,435,091 | A | 7/1995 | Toole et al. | |
| 5,481,819 | A | 1/1996 | Teetzel | |
| 5,784,823 | A | 7/1998 | Chen | |
| 7,249,390 | B2 * | 7/2007 | Yale et al. | 7/128 |
| 7,739,821 | B1 * | 6/2010 | Hamme | 42/8 |
| 7,941,957 | B2 * | 5/2011 | Carr et al. | 42/73 |
| 8,051,594 | B2 * | 11/2011 | Carr et al. | 42/73 |
| 2008/0060248 | A1 * | 3/2008 | Pine et al. | 42/114 |

* cited by examiner

*Primary Examiner* — Michael Carone
*Assistant Examiner* — Samir Abdosh
(74) *Attorney, Agent, or Firm* — Peter A Haas Esquire LLC

(57) ABSTRACT

A compact and foldable survival tool includes a firearm including a trigger and safety lever with many unique features including a compact and folding survival tool with an easy-to-manufacture top strap, a rack and pinion hammer actuator, dual lasers for distress signaling and target and ranging sighting, reconfigurable multiple tools, contained child-safety lock system, folding trigger with safety lever, cam hammer lock, floating firing pin, and cylinder pin assembly positive cylinder lock, for example.

18 Claims, 17 Drawing Sheets

COMPACT FOLDABLE FIREARM WITH SURVIVAL TOOLS

PRIORITY CLAIM

The present application claims benefit under 35 USC Section 119(e) of U.S. Provisional Patent Application Ser. No. 61/185,920 filed on 10 Jun. 2009 titled "Compact Foldable Firearm with Survival Tool," and sharing the same inventor, Ronald D. Simpkins, as the present invention: The present invention is based on and claims priority from this application, the disclosure of which are hereby expressly incorporated herein by reference.

BACKGROUND

The present invention relates to a foldable survival tool, particularly comprising a compact foldable small arms weapon. More specifically, the present invention relates to a folding revolver including any combination of tools including a compass, laser-signaling device, magnified scope, blade, pliers, scissors, waterproof compartment, and other similar devices well-suited for survival in diverse environmental conditions.

Foldable pistols and revolvers are generally understood in the art. One example of a folding pistol includes U.S. Pat. No. 4,625,621 issued to Warin on 2 Dec. 1986. Warrin discloses a foldable machine gun including a magazine with a plurality of rounds, a generally u-shaped receiver adapted to pivotably conceal the magazine and a barrel assembly pivotable with respect to the magazine and receiver, the receiver further being adapted to engage the magazine and barrel in a folded position.

One example of a foldable revolver includes U.S. Pat. No. 1,454,454 issued to Rosier on 8 May 1923. Rosier describes a folding grip and folding trigger mechanism relative to the barrel and cylinder of a revolver.

Yet, despite known foldable sidearms, there remains a need for an improved foldable, compact small arms (sidearms, guns, and the like) device. In particular, such an improved device should combine other tools useful to assist citizens in need, defend personal rights and survive in rugged terrain as might be experienced by back-country adventurers, bush pilots, survivalists, police, rescue workers and the military, for example with a revolver mechanism.

SUMMARY OF THE INVENTION

One objective of the present invention includes providing a rugged survival tool comprising a folding revolver combined with a foldable tool set including a pair of laser emitters adapted for use as a signal laser (green) and a range finder (combination red and green) and a target sight (both red and green depending on light conditions and situation), a glass-breaker, knife, fire-starter and other foldable tools as understood in the art including, for example, known foldable tools as described in U.S. Pat. No. 7,249,390 issued to Yale et al. on 31 Jul. 2007, the entire disclosure of which is incorporated by reference for all purposes as if fully recited herein.

The ballistics graph illustrated of a typical 110-grain .357 Magnum Jacketed Hollow Point (JHP) is one example of how a dual laser ranging system can work. Under a 0.5-inch spread on both lasers the bullet will shoot approximately 1.0-inch to 1.25-inches high following the top laser point. (Red or Green) With a 1.0-inch spread between laser points, the top green laser point is on target at approximately 75-yards. Between a 1.0-inch and 2.0-inch laser point spread, the bullet is on target between the two laser points. At a 2.0-inch laser point spread the bottom red laser point is on target at approximately 110-yards. With a 3.0-inch laser point spread the bullet is on target 3.0-inch below the red laser point at 150 yards; using the spread from the Green/Red laser points as a calibrating reference. There can be many ways to use the concept of the dual laser system depending on calibers, environment and situation.

The ballistics graph illustrated in FIG. 39 traces the bullet trajectory of a typical .357 Magnum round and is one example of how a dual laser ranging system can work. At the Muzzle the red laser is represented at a 1" center below the barrel center and the green laser is represented at 1.5" under the barrel center. Starting with the Red Laser lined up parallel to the barrel, the bullet leaves the barrel 1" high above the Red Laser target point closing in and on target at approximately 60 yards. At 60 yards the spread on the Red Laser point and Green Laser point is approximately 1.5". At 60 yards the target is between the Red and Green Laser to approximately 110 yards where the Green Laser is on target. When the Green Laser is on target at 110 yards the spread between Red and Green Lasers is approximately 2.5".

The rugged, field-ready design according to one preferred embodiment of the present invention consists of a frame, carriage, carrier, and other related mechanical components comprising 416 Stainless Steel with a Rockwell hardness of 43-45 C-scale, heat-treated. In another preferred embodiment the laser-holder comprises an aluminum alloy 7075-T6 to reduce weight and provide a heat-sink for the lasers. The variations of the materials may vary depending on application such as in a Marine environment where salt water is tough on aluminum; the tool may be constructed entirely of stainless steel. Materials can vary depending on specific applications or intended use such as specifications for reduced weight, specific need for increased durability or specific corrosive environments.

In one preferred embodiment of the present invention, a foldable revolver having a single-action, five-shot cylinder with reconfigurable survival tools as required by a situation or environment. Such uses could include a back-packer requiring the use of a wood saw, a fire starter, and a knife. Other contemplated uses include an emergency worker who requires a seatbelt cutter, scissors, forceps, a shear, and possibly, a scalpel. A bush pilot may need a line cutter, wire cutter, knife, fire-starter, pry bar, hacksaw, wood saw or compass. From urban environments into the rugged outdoors, survival requirements differ. Accordingly, alternative embodiments of the present invention provide specialized tools as required by the intended use. More importantly, in one contemplated embodiment, the survival tool could be configured for police work during the week and then quickly and easily reconfigured by the same user for the weekend camp trip.

Safety features of the present invention include a child-proof keyed lock mechanism adapted to prevent opening or unfolding of the revolver from the handle when in the closed or locked position. A standard, law-enforcement hand-cuff keyed-lock mechanism ensures universal fitting for gun-owners, military, and law enforcement. The child lock is an integral component of the revolver handle and remains with the weapon at all times whether in the locked or unlocked condition.

Other safety features include:

Locking Firearm in the closed position: Rotating the handle to the closed position operates the cam locking pin securing the hammer in the upright position preventing the possibility of firearm operation.

Preventing accidental discharge: a biasing member forces the hammer block mechanism in a normally closed position. The biasing mechanism requires at least three-pound operating force to over-come the normally blocked position. A one-pound operating force on the safety trigger button levers the 3 pound operating force on the block biasing mechanism to free the hammer block. Without maintaining depression of the safety trigger button the firearm can not be discharged by being dropped or accidental bumping of the trigger.

Distress signaling device: The green laser distress signaling device can be a very powerful tool in locating lost hikers, using as a tactical SWAT tool for positioning, finding a boater lost at sea or locating a rock climber stuck on a mountain. When in distress the green laser can be operated on a dark night illuminating the bright green laser beam (not just the laser point) for over 4 miles when unobstructed. Whether utilizing the green laser as a separate device or with the Survival Firearm multi-tool, the distress signal will save lives.

Auto window breaker: As part of the frame member; available for rescuers after an auto accident enabling a rescuer to free victims entrapped in a mangled vehicle. Also the window breaker can be very effective in defense for striking and stunning an attacker.

Contamination: Other safety design aspects include a closed operating mechanism preventing contamination of the firearm mechanisms when the survival tool is folded; also a rugged and robust design.

Another objective of the present invention includes providing a single-action revolver that can accommodate different rounds with the same firearm. The 32 caliber can use .32 Smith and Wesson rounds, .32 Smith and Wesson Long rounds, .32 HR Mag rounds, .327 Ruger rounds, and .32 caliber PPE Mag rounds or shot shell rounds. The 32 caliber accommodating different rounds provides versatility to meet varying requirements; easy for the elderly to handle, indoor personal protection or more power for use outdoors. The design of the compact folding firearm can be adapted to many popular size calibers.

Another feature of the invention includes a locked-safe position of the fire arm portion of the tool with operable folding knives. That is, the firearm may be folded and locked by a key-lock, with a barrel-guard covering the opening of the barrel and a hammer lock juxtaposed between the firing pin and the chamber, yet the folding knives or other folding tools in the handle-portion may be opened and used normally.

Additional features include a variety of folding knife blades of various lengths and thicknesses and other tools including a fire-starter.

DRAWING

DESCRIPTION OF THE INVENTION

Possible embodiments will now be described with reference to the drawings and those skilled in the art will understand that alternative configurations and combinations of components may be substituted without subtracting from the invention. Also, in some figures certain components are omitted to more clearly illustrate the invention.

Figure 1:
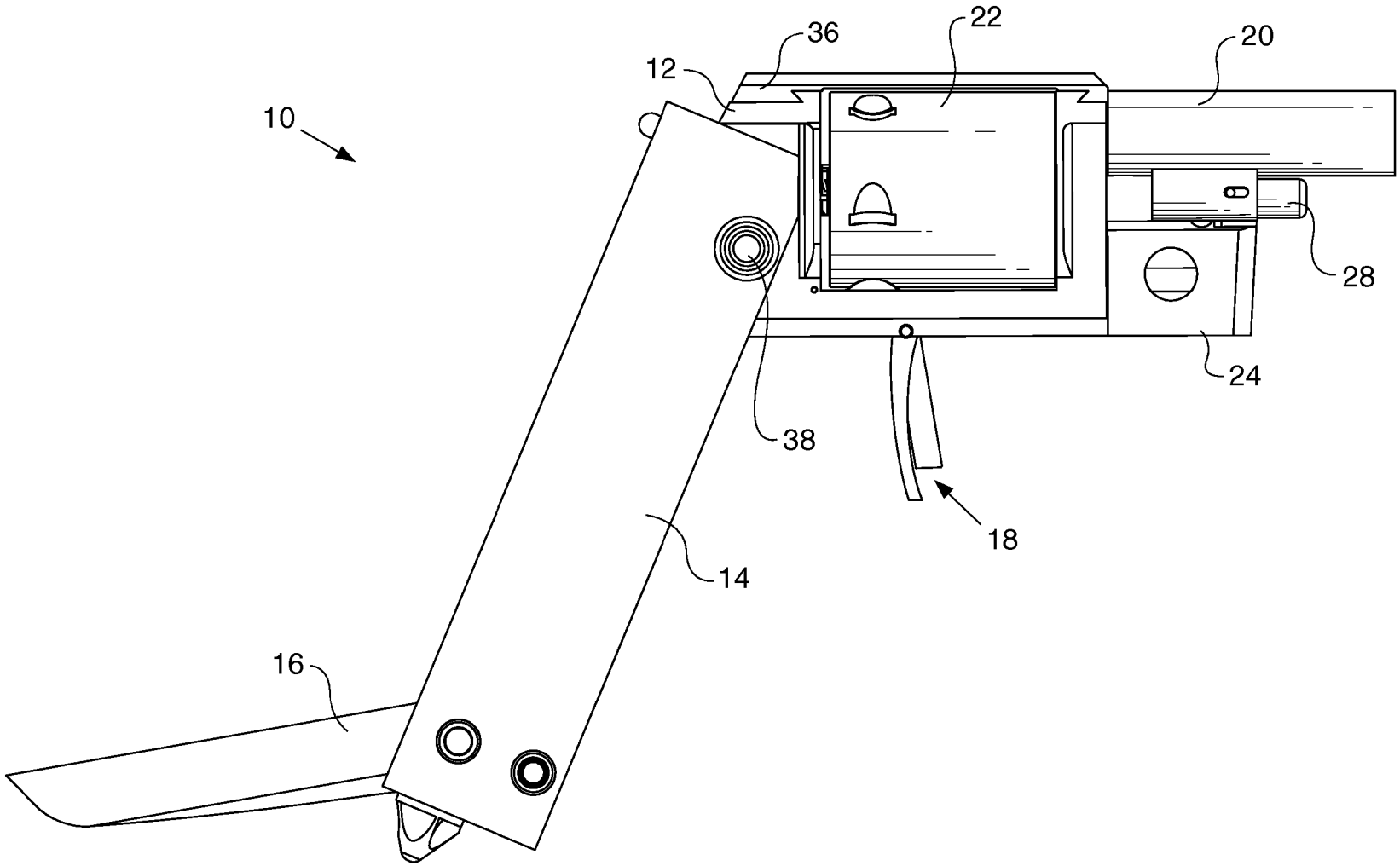
FIG. 1 is a left side view of one preferred embodiment of the present invention in an extended position.
Figure 15:
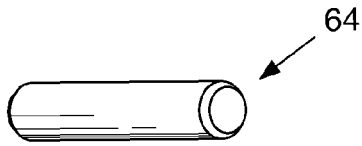
FIG. 15 is an offset side view of a handle pin component of the embodiment of FIG. 1.
Figure 16:
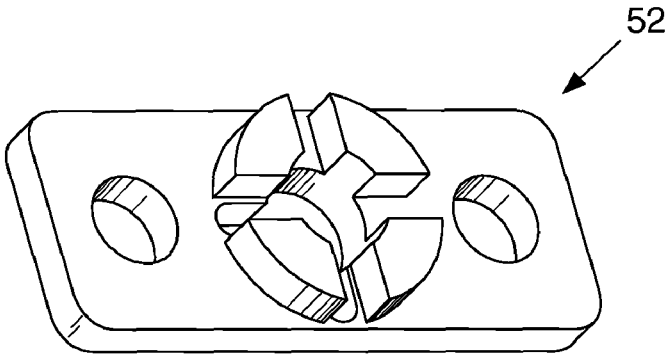
FIG. 16 is an offset bottom view of a key plate component of the embodiment of FIG. 1.
Figure 17:
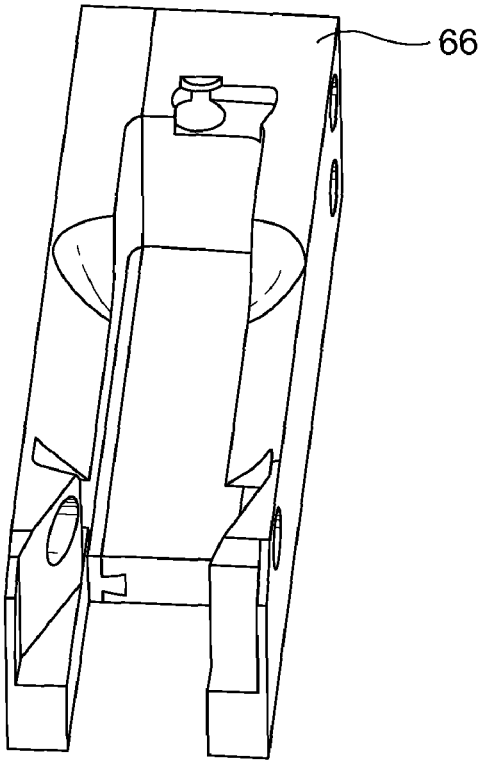
FIG. 17 is an offset top view of a knife holder assembly of the embodiment of FIG. 1.
Figure 18:
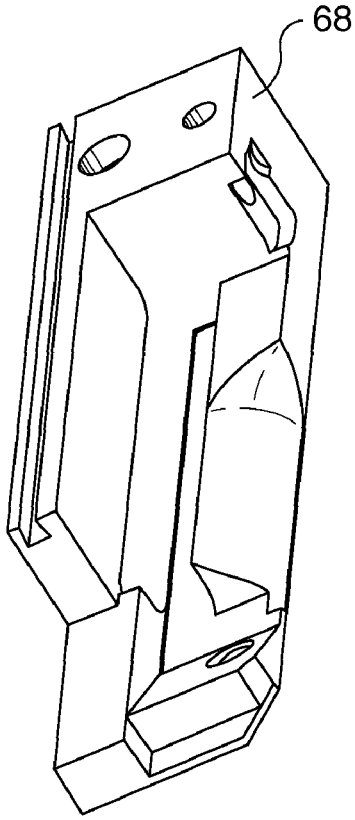
FIG. 18 is an offset top view of a long-version knife holder component of an alternate preferred embodiment of the present invention.
Figure 19:
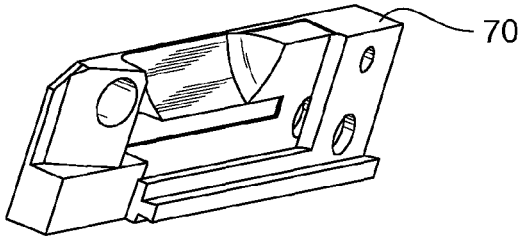
FIG. 19 is an offset side view of a short-version knife holder component of yet another preferred embodiment of the present invention.
Figure 20:
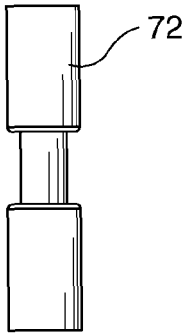
FIG. 20 is a side view of a knife pin component of the embodiment of FIG. 1.
Figure 21:
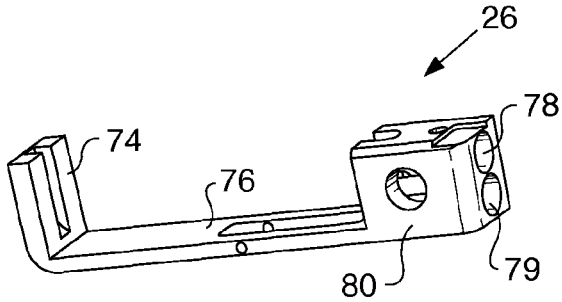
FIG. 21 is an offset side view of a laser holder component of the embodiment of FIG. 1.

Referring specifically to FIG. 1, an overview of a preferred embodiment of the present invention includes several components that are detailed in FIGS. 2-38 and discussed further, below. This first preferred embodiment of the present invention 10, as FIG. 1 illustrates, includes a compact foldable firearm with survival tools. The foldable firearm 10 includes a handle portion (or carriage) 14 that includes one or more foldable tools 16. The handle portion pivotably mounts to a firearm frame member 12. The frame 12 carries a cylinder 22 coupled to a barrel 20. The cylinder 22 rotates open for loading by releasing the cylinder lock pin 28, and its operation is conventional as would be understood by those of ordinary skill in the art. The frame 12 further includes a block or carriage 13 (of FIG. 3, for example) including a dovetail feature 99 pressed on top member 25 of the frame 12. The firearm sub frame 12 further carries a foldable trigger assembly 18. The frame further includes a top strap 36 secured with screws, for example, for increased frame-strength, and it is further adapted to retain the cylinder 22 in place. A handle pin 38 (of FIG. 15, for example) is the pivot pin between the handle and the firearm and further serves as the axis of rotation of the handle relative to the barrel.

Figure 2:
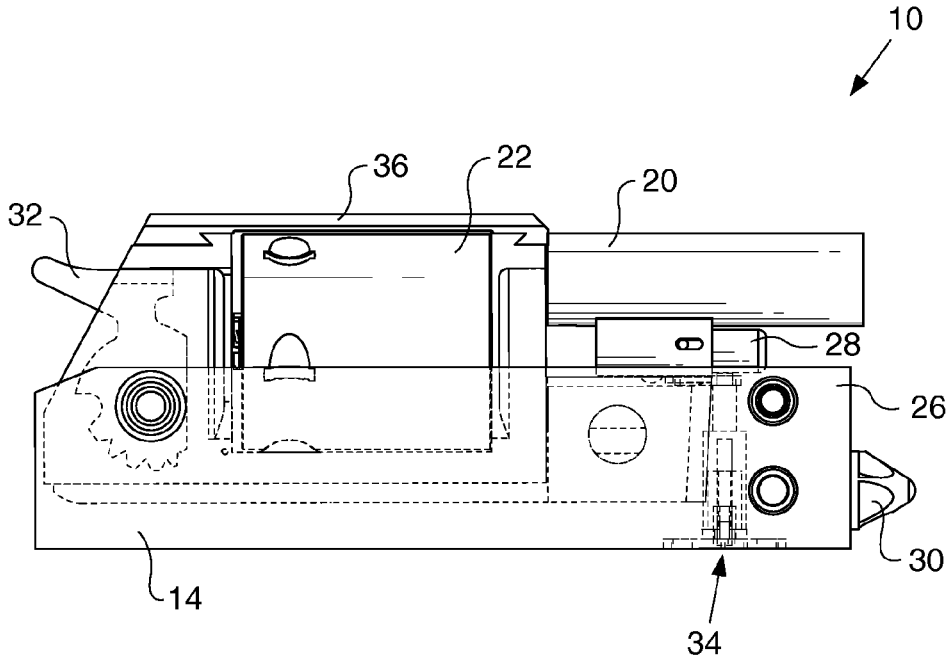
FIG. 2 is a left side cut-away view of the embodiment of FIG. 5 in the folded position.
Figure 5:
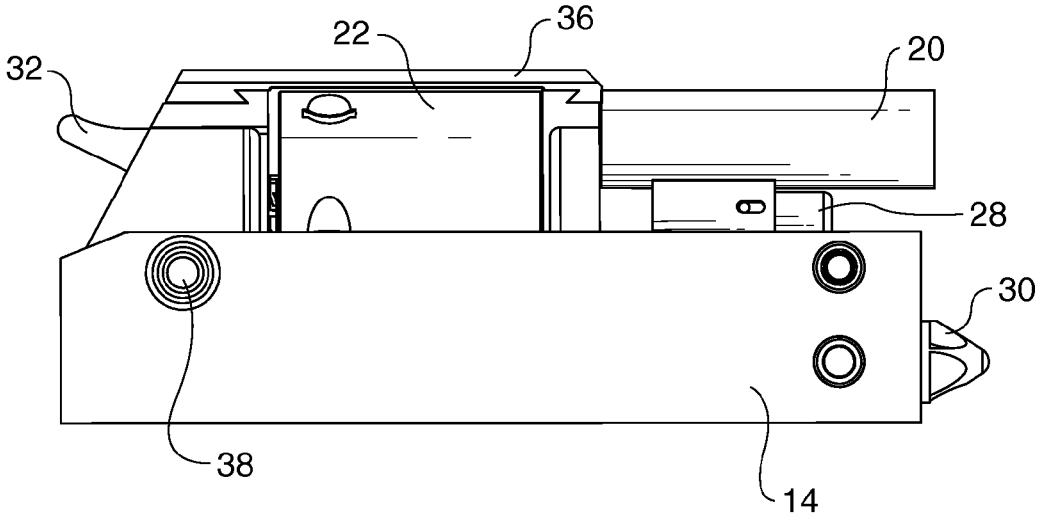
FIG. 5 is a left side view of the embodiment of FIG. 1 in the folded position.
Figure 6:
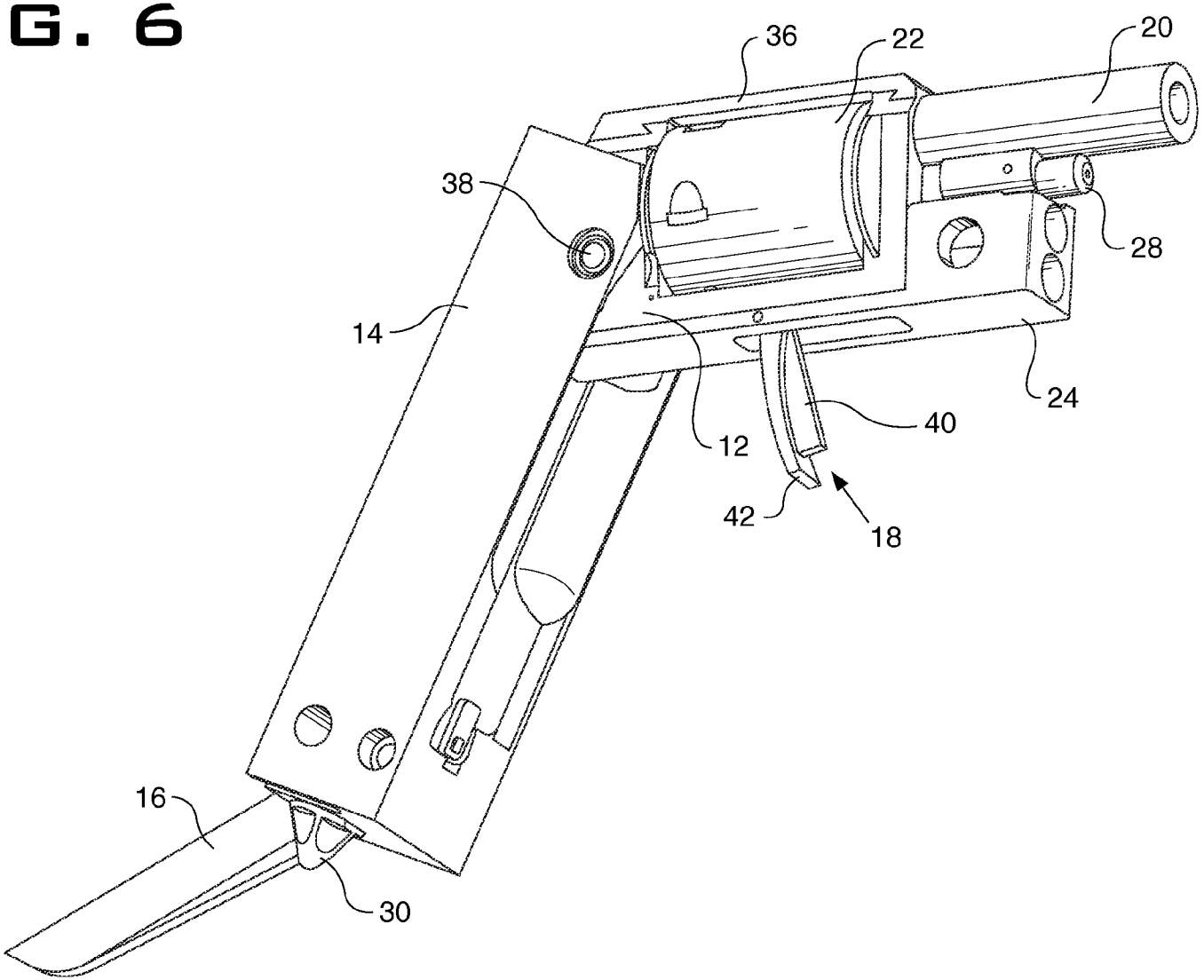
FIG. 6 is an offset side view of the embodiment of FIG. 1.
Figure 7:
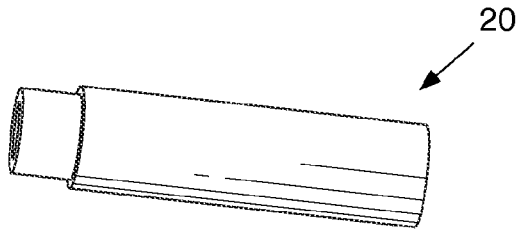
FIG. 7 is an offset side view of a barrel of the embodiment of FIG. 1.
Figure 8:
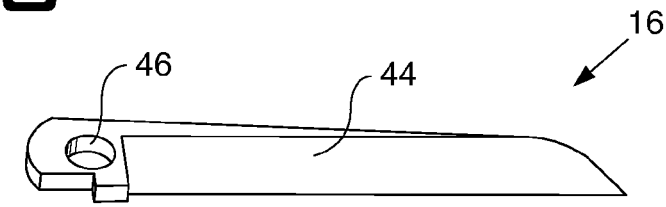
FIG. 8 is an offset side view of a knife blade of the embodiment of FIG. 1.

FIGS. 1 and 6 illustrate the present invention 10 in an extended position, whereby the firearm and/or the foldable tool or tools are accessible for ordinary use. In contrast, FIGS. 2 and 5 illustrate the present invention in a collapsed or folded position. In the folded position, the firearm is rendered inoperable, but the foldable tools are available for normal use. Of particular note, in the folded position, the trigger assembly 18 pivots forward from a generally vertical position to a substantially horizontal position, a hammer-strike plate extends between the hammer and the firing pin and this prevents the hammer from retracting and striking the firing pin, even if the device is dropped. An additional safeguard includes a child-safety locking mechanism 34 (FIG. 9), which is further described, below.

Figure 29:
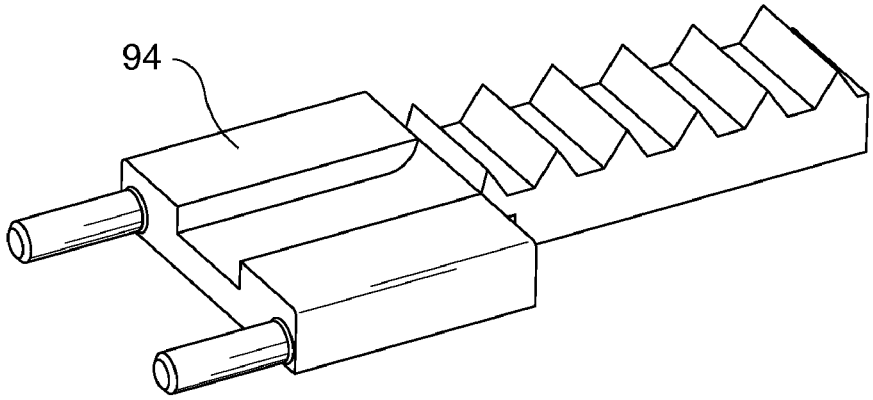
FIG. 29 is an offset side view of a rack component of the embodiment of FIG. 1.

One key difference of the present invention over known folding firearms includes a unique ratchet rack 94 as FIG. 29 shows. Rather than pivot the handle portion 14 relative to the frame 12 on a fixed radius and single pivot point (pivot pin 38, which fits in mounting hole 108 on the carriage—see FIG. 3, for example) and adapt the handle to receive the cylinder and barrel 20 (of FIG. 7, for example) as taught in the prior art, the rack 94 enables this firearm 10 to fold in a compact position, encapsulating a portion of the frame 12, yet leaving a portion of the handle for other tools (such as a foldable tool 16). This rack 94 utilizes flat springs to enable the firearm to be compact and fold against the handle portion.

Figure 12:
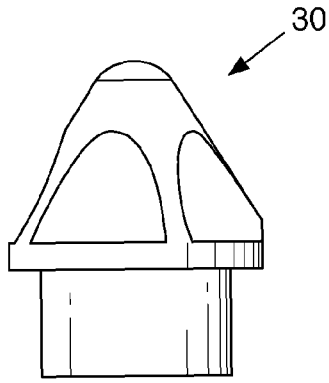
FIG. 12 is a side view of a glass-breaking component of the embodiment of FIG. 1.

With particular reference to FIG. 2, it will be appreciated that a glass-breaking device 30 is operable for use in the folded position as it extends beyond the frame and barrel. This glass-breaking device is also operable in the extended position (as FIG. 1 shows, for example). FIG. 12 further details the glass-breaking device 30. This is a conventional glass-breaking tip as would be well understood in the art. One contemplated glass-breaking device suited for use with the present invention includes the glass-breaker model number 10105 ERT-1 available from Benchmade of Oregon City, Oreg., USA.

Figure 3:
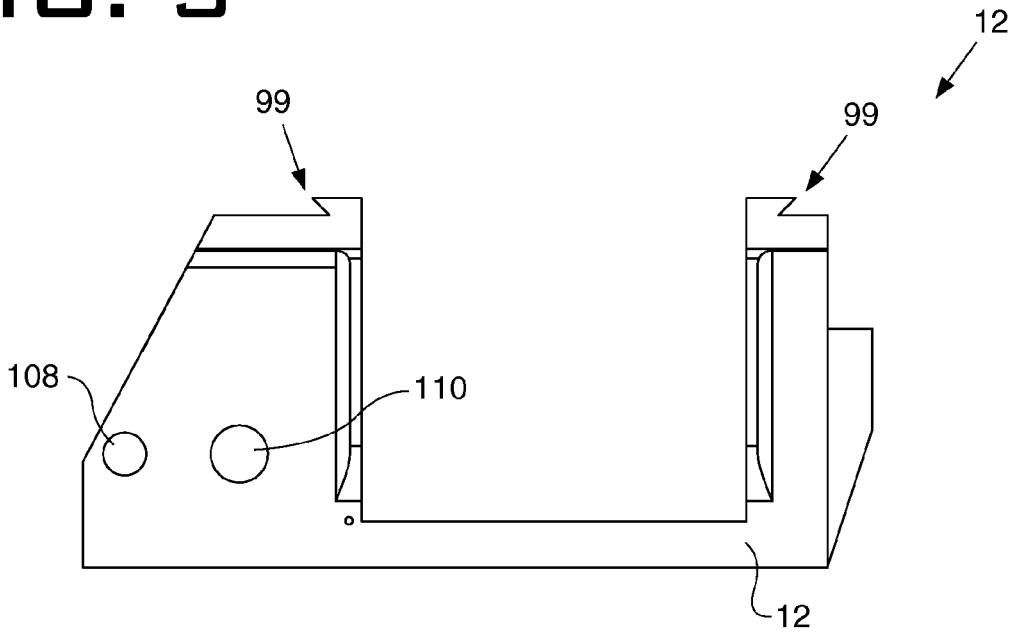
FIG. 3 is a side view of a frame component of the embodiment of FIG. 1.
Figure 30:
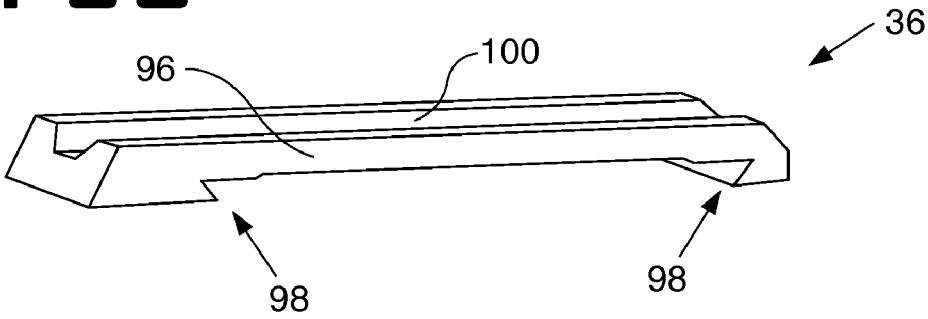
FIG. 30 is an offset side view of a top strap component of the embodiment of FIG. 1.
Figure 31:
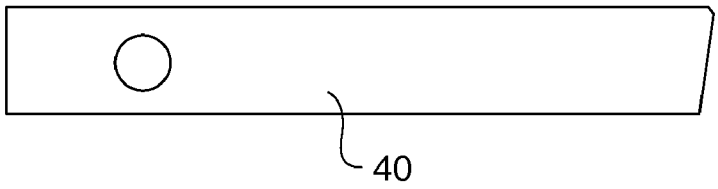
FIG. 31 is a side view of a trigger safety lever component of the embodiment of FIG. 1.
Figure 32:
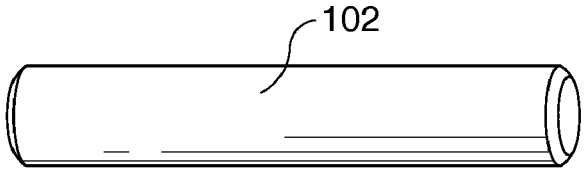
FIG. 32 is an offset side view of a trigger pin of the embodiment of FIG. 1.
Figure 33:
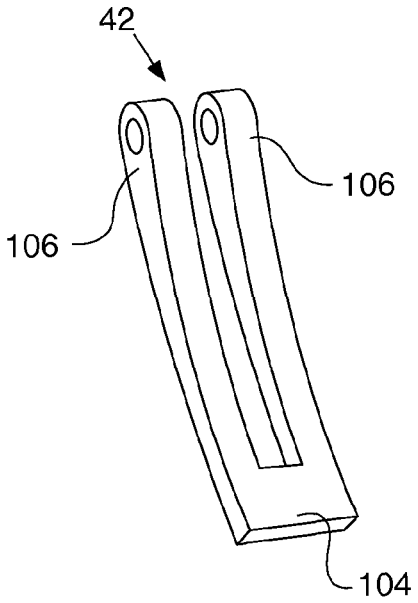
FIG. 33 is an offset side view of a trigger component of the embodiment of FIG. 1.
Figure 33A:
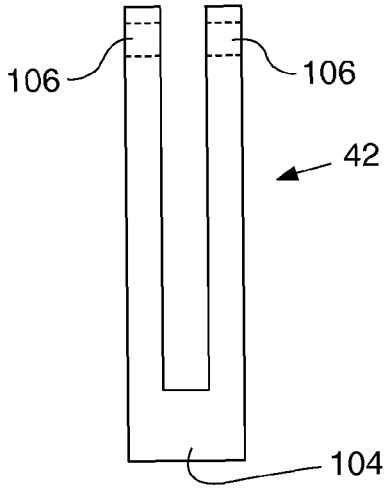
FIG. 33A is a front view of the trigger of FIG. 33.
Figure 33B:
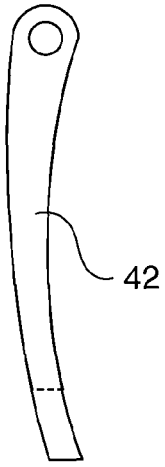
FIG. 33B is a side view of the trigger of FIG. 33.
Figure 33C:
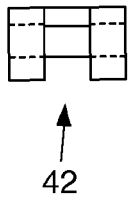
FIG. 33C is a top view of the trigger of FIG. 33.
Figure 34:
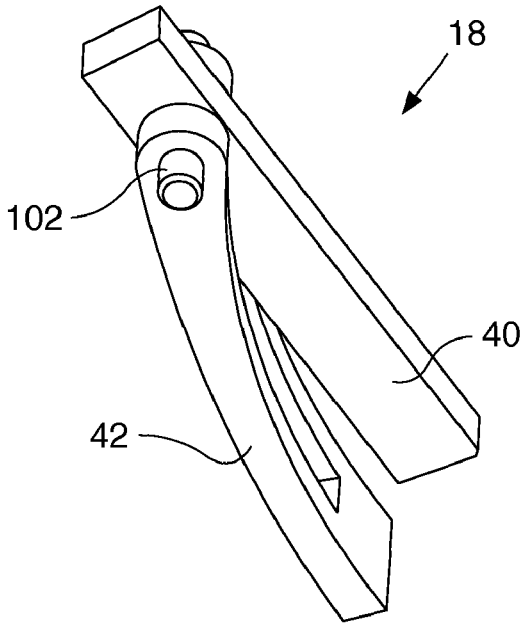
FIG. 34 is an offset side view of a trigger assembly of the embodiment of FIG. 1.
Figure 35:
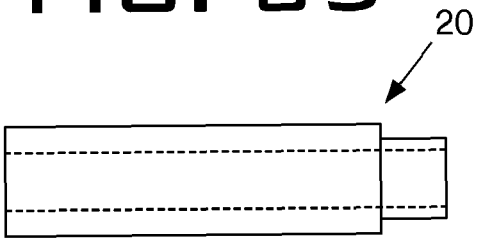
FIG. 35 is a left side view of the barrel of FIG. 7.
Figure 35A:
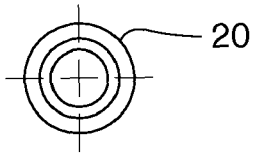
FIG. 35A is a front view of the barrel of FIG. 35.
Figure 35B:
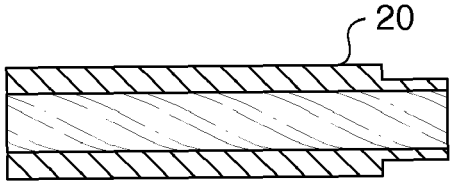
FIG. 35B is a right side view of the barrel of FIG. 35.
Figure 36:
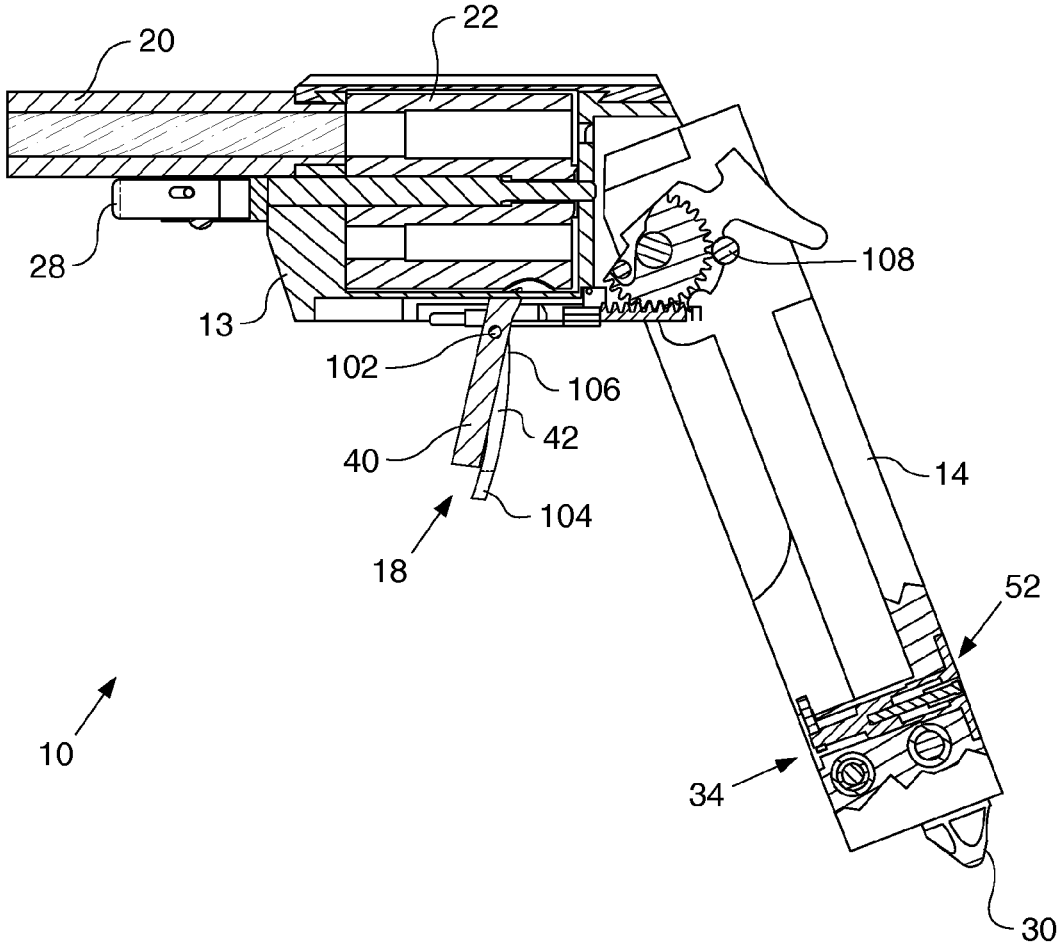
FIG. 36 is a right side view of the present invention in an open position.
Figure 37:
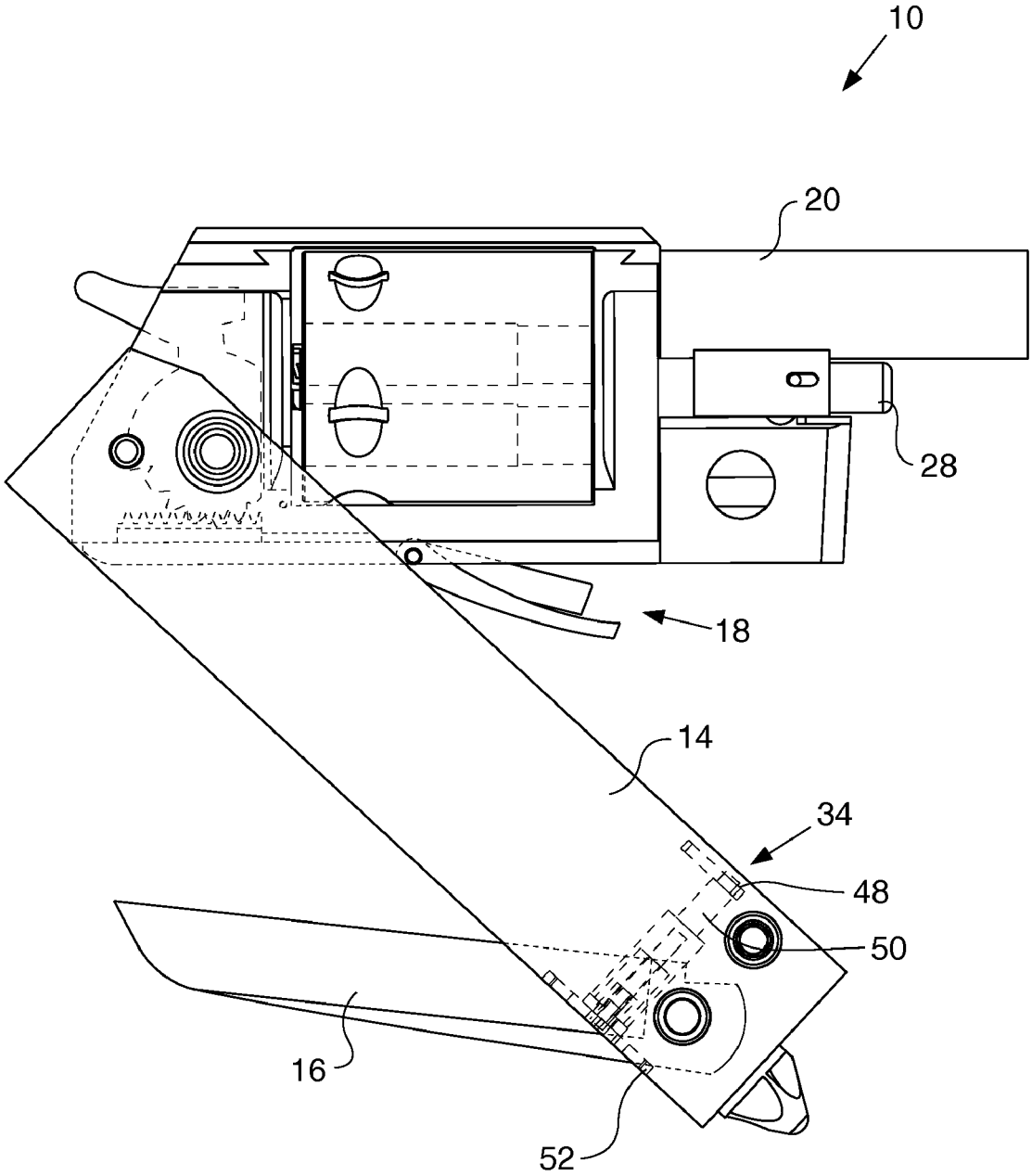
FIG. 37 is a left side view of the present invention showing the handle portion transition to an open or closed position relative to the firearm portion.
Figure 38:
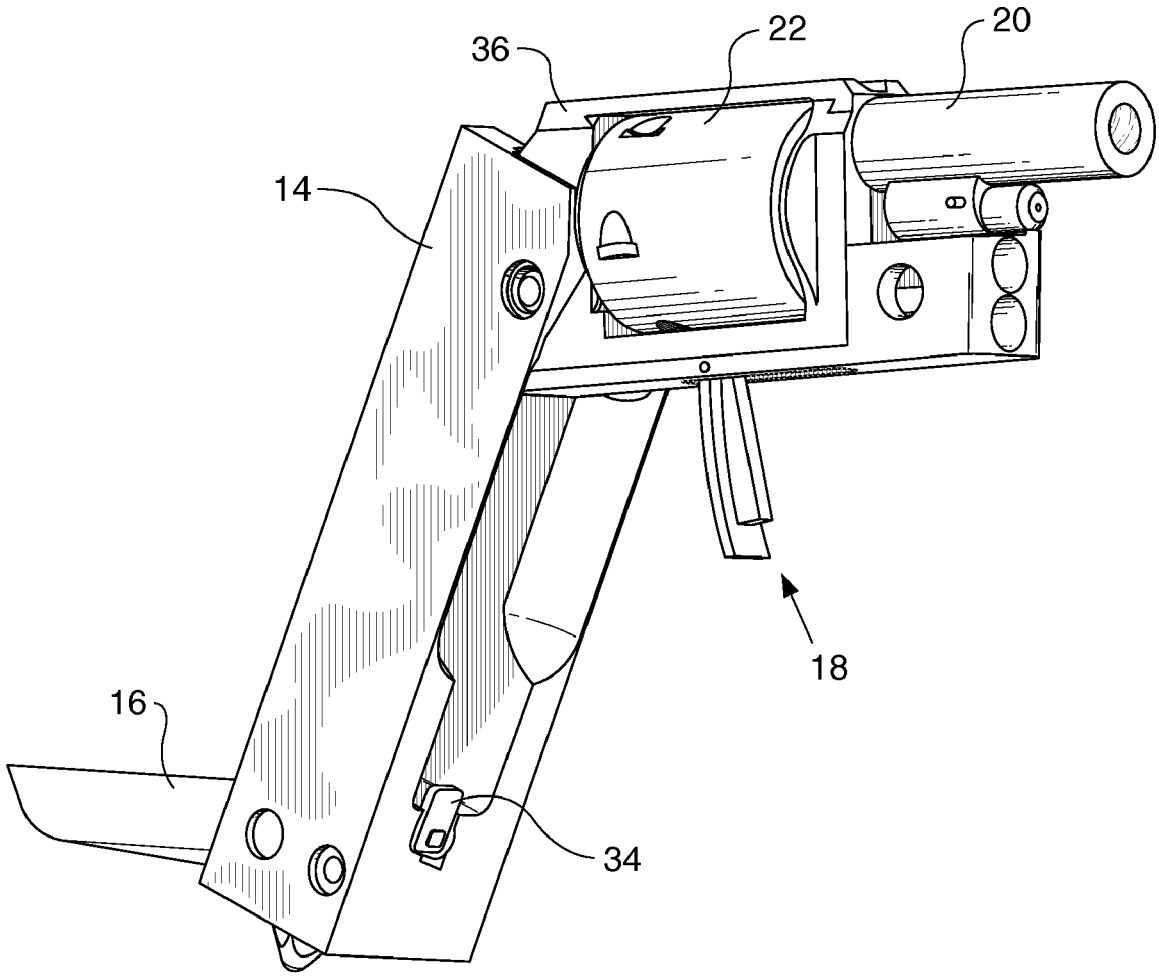
FIG. 38 is an offset frontal view of the present invention in the open position.
Figure 39:
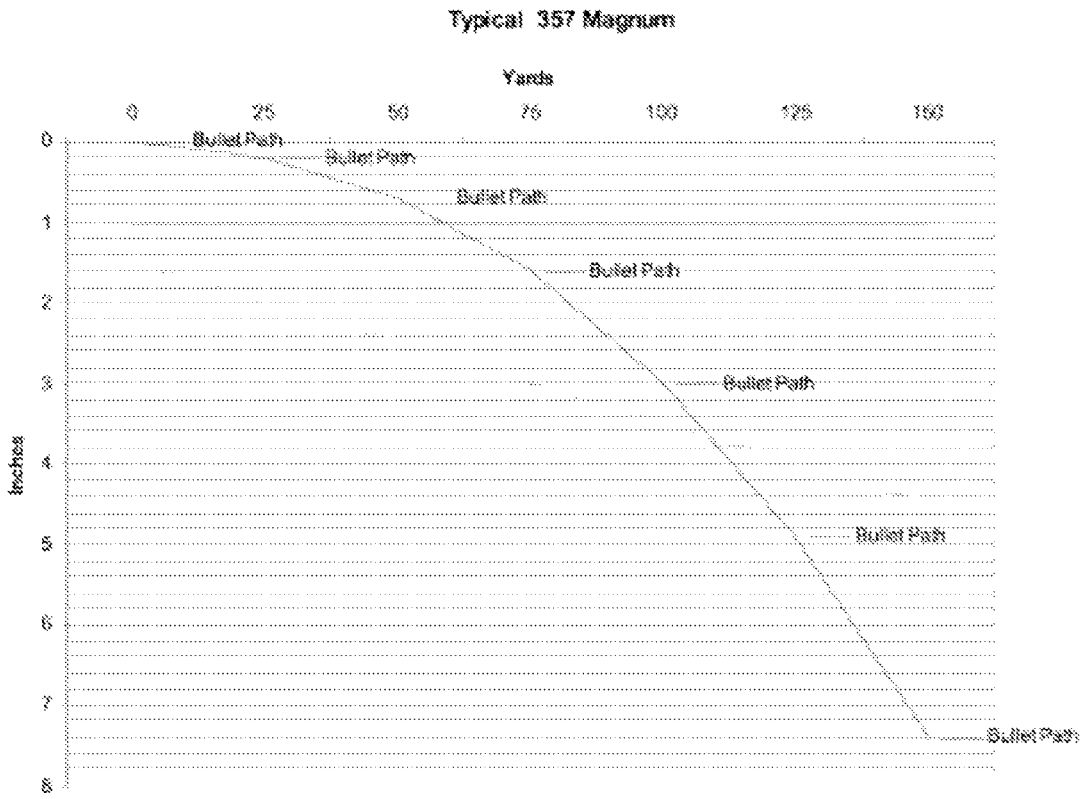
FIG. 39 is a chart showing a typical ballistic flight path.

Referencing now FIG. 3, the firearm carrier sub-frame 12 includes carriage 13 consisting of a generally rectilinear cross section when viewed from the front and, in profile, resembles a square-U-shape with an open top portion including a press-fit top portion 25 adapted to receive the top strap 36. The top portion 25 includes dovetail features 99 adapted to mate to the top strap 36. The top strap 36, as FIG. 30 illustrates, is a simple design of a generally rectilinear shape with a top groove 100 running the long, fore-aft axis and having opposing tapered shoulders 98 at each end of the body 96. Thus screws pins vertically inserted through the top surface of the top strap couple the strap to the frame 12, allowing economical manufacturing of the device 10. Additionally, the top groove 100 serves as a manual-sighting plane.

Still referencing FIG. 3, the firearm chassis assembly 12 includes a sub frame or carriage 13 including a hammer-pivot mounting hole 110 and a hammer block-pin mounting hole 108 (for engaging pin 38). As will be appreciated from FIGS. 1 and 36-38, as the trigger assembly 18 is pulled toward the handle when the invention 10 is in the open position, the hammer pin ratchets rearward about its pivot axis devised to align with the pin mounting hole 110 until it is limited in travel rearward by the block pin 109 inserted in mounting hole 108. The hammer pin accelerates to the strike plate only when the hammer is at its full rearward, pivoted extension and the trigger 42 and safety 40 are pressed with sufficient force, as described in further detail herein.

Figure 4:
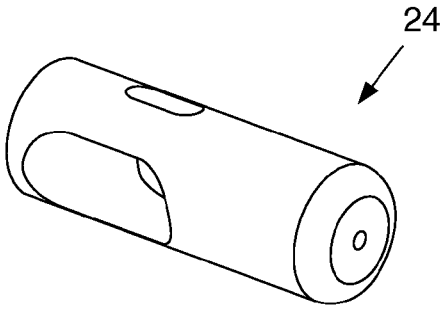
FIG. 4 is an offset frontal view of a block component of the embodiment of FIG. 1.

FIG. 4 illustrates the block 24, a cylinder-release button. Of particular note, a cylinder release button includes a ball bearing and internal geometry to provide a constant pressure lock.

Another key feature of this first preferred embodiment includes the trigger assembly 18. As FIGS. 6, and 31-34, and 36 detail, the trigger assembly includes a trigger pin 102, which enables the trigger 42 and safety lever 40 to fold forward and upwards from a near vertical (operable) position to a horizontal (closed position). Also, the trigger 42 includes a base 104 and two arms 106. Disposed intermediate to the arms 106, the safety lever 40 (or lever 102 in this figure) shares a common rotation axis with the common pin 102. The safety lever (latch pin 84) mechanically couples to a hammer-block plate, pulling the normally closed plate (by means of a biasing member, latch spring 86) away from the hammer by a 3-lb force spring that results in a one-pound pull force due to the internal geometries and lever-affect. The hammer is physically pulled to the cock position where the trigger requires a 5-lb pull force to release. And, only by having pressure on both the safety 40 and the trigger 42 will the firearm discharge. This design eliminates the conventional trigger guard as taught in the prior art, allowing for a more compact and foldable design in this preferred embodiment and—importantly—preventing misfire in the event the firearm is bumped or dropped as the trigger serves as a "trigger guard" relative to the safety lever. The safety lever 40, moreover, requires a continuous positive force of 1-lb pull and the firearm cannot be fired with out this intentional pressure on the safety.

Figure 9:
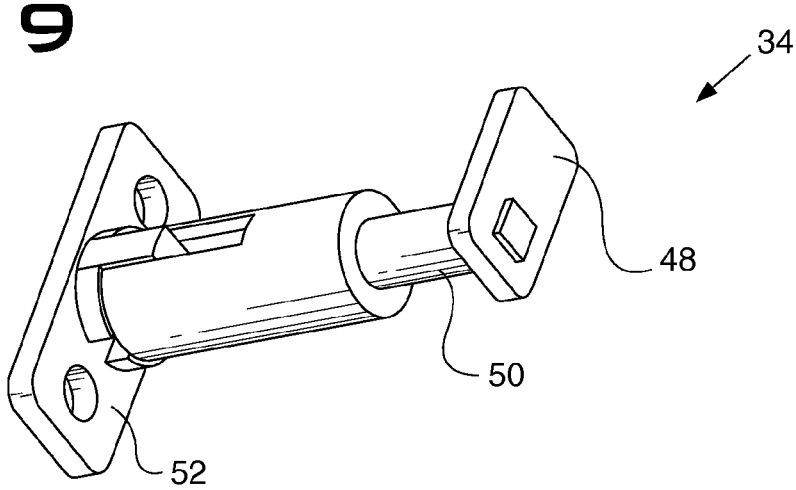
FIG. 9 is an offset side view of a child-lock assembly of the embodiment of FIG. 1.

FIG. 9 details a lock assembly 34 to render the firearm portion of the foldable survival tool "safe". The lock assembly fits inside a portion of the handle as FIGS. 36-38, for example, show. When the handle portion is in the folded position, a portion of the handle 14 covers the firearm subframe 12 and the foldable trigger assembly 18 pivots upward to attain a horizontal position and sits relatively flush with the carriage 13. Thus, when folded, the trigger cannot be accessed due to the handle portion covering the entire trigger and a lower portion of the carriage 13. Accordingly, the keyed lock assembly 34 includes a key plate 52 with a keyed opening, the keyed opening contains a police-grade or military-grade mechanism as would be well understood in the art. A shaft 50 couples the key plate to the locking plate 48; the shaft rotates as would be conventionally understood in the art. The locking plate 48, therefore, selectively engages a portion of the carriage 13 so that when in the folded position and locked with a key, the foldable survival tool cannot be unfolded and thus cannot be fired as the hammer lock will be in the closed position (as previously described) and the trigger would not be accessible.

As mentioned, the handle portion 14 includes space for one or more foldable tools 16, or preferably two individual spaces, each with the capacity for one or more folding tools. In this first preferred embodiment the compact, folding firearm and survival tool includes a folding blade 44 mounted by a blade pin through opening 46 (see FIG. 8, for example), and its opening and closing is facilitated by one or more blade washers. The blade locks into the open position with a knife pin 72 of FIG. 20, for example. The operation and locking of the blade is well understood in the art. In other preferred embodiments one or more blades, or other foldable tools (such as a saw blade, scissors, file, punch, awl, spoon, fork, spork, or other known implements would work equally well).

Figure 10:
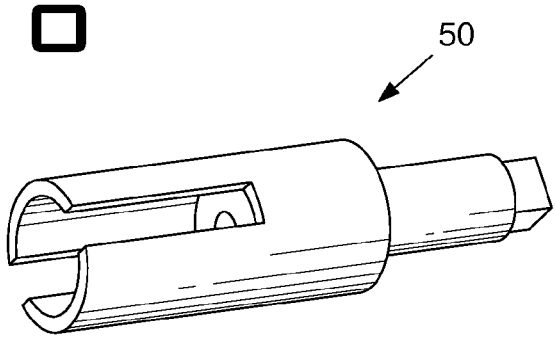
FIG. 10 is an offset side view of a child-lock cylinder assembly of FIG. 9.
Figure 22A:
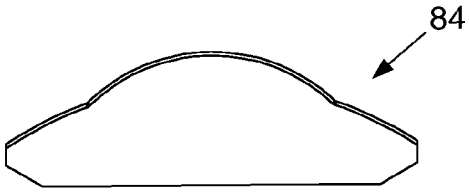
FIG. 22A is a front view of the latch pin of FIG. 22.
Figure 22B:
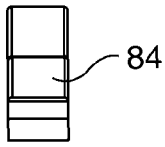
FIG. 22B is a top view of the latch pin of FIG. 22.
Figure 22C:
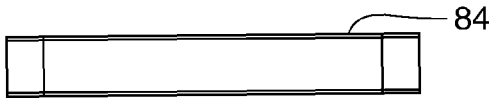
FIG. 22 is a side view of a latch pin component of the embodiment of FIG. 1.
Figure 23:
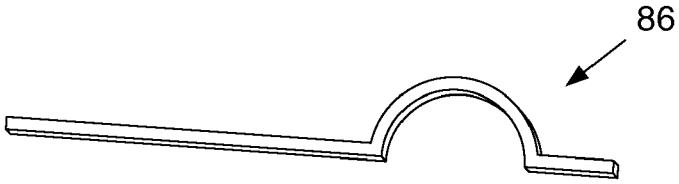
FIG. 23 is a side view of a latch spring component of the embodiment of FIG. 1.
Figure 23A:
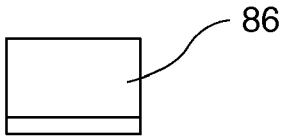
FIG. 23A is a front view of the spring of FIG. 23.
Figure 23B:
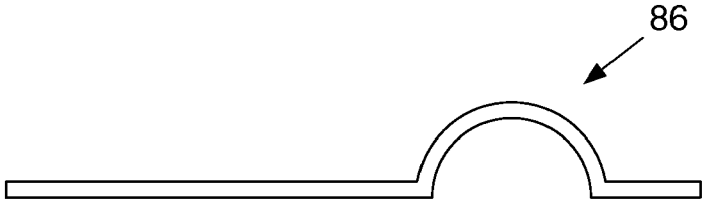
FIG. 23B is a side view of the spring of FIG. 23.
Figure 23C:
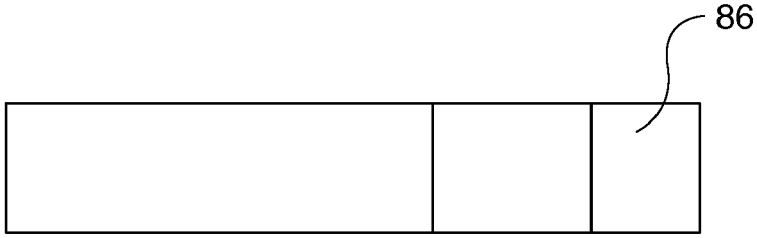
FIG. 23C is a top view of the spring of FIG. 23.
Figure 24:
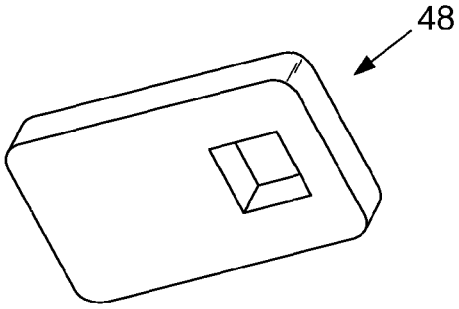
FIG. 24 is an offset side view of a latch component of the embodiment of FIG. 1.

Another key feature of the first preferred embodiment of the foldable firearm and survival tool 10 includes the child-lock safety mechanism assembly 34. FIGS. 9 and 10 detail the assembly 34 including a cylinder body 50 with a latch plate 48 (see FIG. 24, for example) at one end and a lock-receiving opening at the opposite end. A key plate 52 (see FIG. 16, for example) fixably couples to the handle portion 14. A standard law-enforcement lock fits in the body 50 and the cylinder resides in the handle portion. When the firearm is in the closed position, a turn of the key rotates the cylinder body 50, pivoting the latch 48 into a mating feature on the frame 12. FIGS. 22 and 23 detail the cylinder latch pin and cylinder latch spring, which provide unique geometry allowing positive cylinder latching and a compact device.

Figure 25:
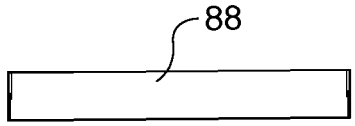
FIG. 25 is a side view of a lock roll-pin component of the embodiment of FIG. 1.

FIG. 25 details the child-safety lock roll pin, which centers the key and renders the lock difficult to pick.

Figure 11:
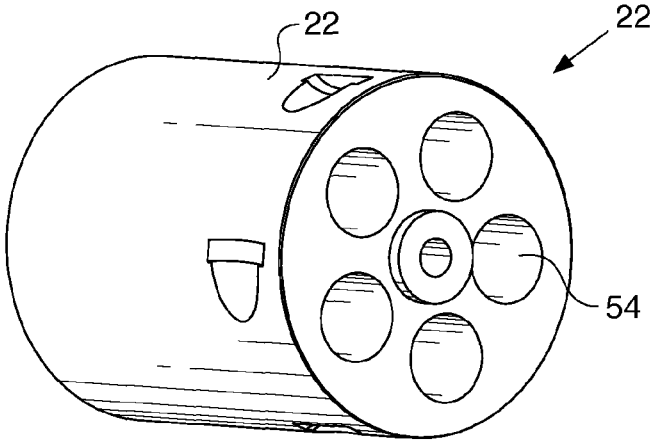
FIG. 11 is an offset side view of a cylinder of the embodiment of FIG. 1.

FIG. 11 illustrates a cylinder 22 with five chambers 54 with robust design and improved inherent safety over conventional firearms.

Figure 13:
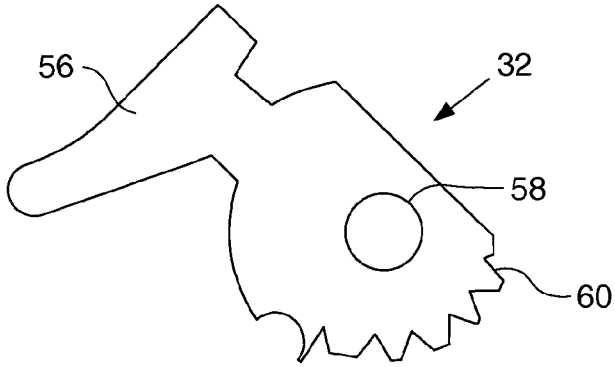
FIG. 13 is a side view of a hammer component of the embodiment of FIG. 1.
Figure 14:
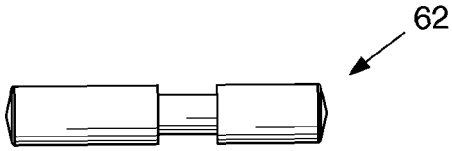
FIG. 14 is a side view of a hammerlock pin component of the embodiment of FIG. 1.

FIG. 13 details the hammer 32 including the pull 56 and gear teeth 60. The hammer pivotably mounts using pin 64 (FIG. 15) at opening 58, the pivot point or the frame 12 and handle portion 14. A hammer lock-pin 62 (of FIG. 14, for example) in a cam operation ramps inside handle and shifts the hammer locking pin into a locked position when moving from open to folded position.

Another key aspect of the first preferred embodiment of the present invention includes dual lasers for sighting and range finding. The dual lasers, one red, one green, mount in a laser holder 26 (see FIG. 21, for example). The laser holder is fixed or coupled to the frame 12 by means of screws (or other suitable permanent or semi permanent fasteners) through the base 76 into the frame 12. A pronged laser frame arm 74 extending generally vertically from one distal end of a horizontal frame body base 76. A laser housing 80 locates at the proximal end of the body 76 and includes openings for each laser 78 79. Operation and use of the laser was presented earlier in this document. One suitable and contemplated dual laser mechanism is disclosed in the present inventor's co-pending provisional patent application No. 61/286,665 filed on 2009-12-15 titled "Munitions-specific, dual-laser sighting device," the entire disclosure of which is expressly incorporated by reference as if fully set forth herein. Accordingly, the laser holder consists of a housing and rail, machined from a solid block of 60-61 T6 aluminum, however, 70-75 T6 works as well. Of course, other materials could be substituted including, but not limited to brass, platinum, silver, nickel, gold, stainless steel, steel, and carbon fiber. And the parts can be cast or forged in lieu of machining. Suitable red and green lasers are available from Creative Tech Lasers of Walnut Creek, Calif., USA. And include a [Green laser Model PS-3-5 with an output power of 4.5 mW and a current of 250 mA at 3 volts DC with a wavelength of 532 nm. The red laser Model LMAPCD-650-01 uses APC (auto power control) and is rated at 3 mW at 3 volts DC and emits a wavelength of 650 nm. Suitable switches for selective on/off operation of each red and green laser includes a single-pole, double-through 6A, 120 V rated switch available as part number 1101M2S2CQ2E2 available from Master distributors of Santa Monica, Calif., USA.

Figure 26:
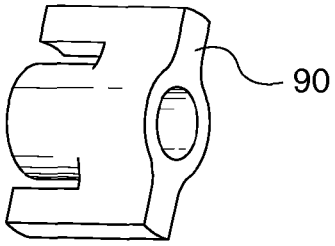
FIG. 26 is an offset side view of a lock slider component of the embodiment of FIG. 1.

FIG. 26 shows the lock slide 90 whereby a key pushes up, out of contact with the latch plate 52 and allows 90-degrees of rotation of the cylinder body 50 and latch plate 48.

Figure 27:
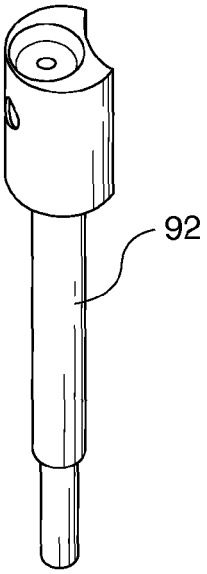
FIG. 27 is an offset top view of a cylinder pin component of the embodiment of FIG. 1.
Figure 28:
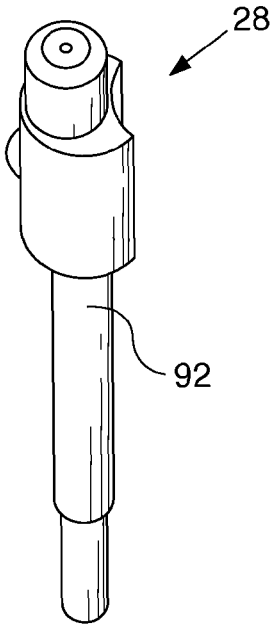
FIG. 28 is an offset side view of a cylinder pin assembly of the embodiment of FIG. 1.

FIGS. 27 and 28 detail the cylinder lock pin assembly 28 including pin 92. A robust design provides constant latching pressure retaining the cylinder from being removed. Pushing the cylinder latch button 24 allows the cylinder pin assembly 92 to be extracted allowing the cylinder 22 to be removed for reloading. The cylinder pin assembly can be used to push out bullet casings from the chamber 54.

Although the invention has been particularly shown and described with reference to certain embodiments, it will be understood by those skilled in the art that various changes in form and detail may be made without departing from the spirit and scope of the invention.

I claim:

1. A foldable survival tool comprising:

a frame member comprising a handle-portion, a pivot element, and a firearm sub frame wherein the handle-portion selectively rotates with respect to the firearm sub frame by means of the pivot element, the handle-portion further being adapted to receive a portion of the firearm sub frame when the frame member is in a first, folded position, the frame member further being operable in a second, open position;

the firearm sub frame further comprising a carriage and a foldable trigger assembly coupled to the carriage, the trigger being operable in at least two positions including a folded position and a firing-ready position;

and wherein the foldable trigger assembly further comprises:

a forked trigger comprising a base and two upward reaching arms, a trigger pin mounting through hole is disposed at each respective distal end of each arm;

a safety lever disposed intermediate to the two arms, the safety lever having a trigger pin mounting hole aligned with the trigger pin mounting through holes of the two arms; and a trigger pin mounted to the carriage, the trigger pin suspending the forked trigger and safety lever at each respective trigger pin mounting hole to the carriage, the trigger pin further being operable to enable the forked trigger and safety lever to fold forward and upwards from a near vertical, operable position to a horizontal, closed position.

2. The foldable survival tool of claim 1 wherein the fire-arm sub frame further comprises:

a carriage consisting of a generally rectilinear cross section when viewed from the front and, in profile, resembles a square-U-shape with an open top portion;

a press-fit top portion coupled to a top portion of the carriage, the top-portion including a dovetail feature;

a top strap adapted to mate with the dovetail feature of the top strap and couple to the top strap;

a barrel coupled to a front portion of the carriage, the barrel including a hollow cylindrical passage having two opposite and linearly aligned open ends one end being coupled to the carriage;

a cylinder aligned with the barrel, the cylinder being rotatably mounted to the carriage, the cylinder including at least one chamber, the at least one chamber having two oppositely disposed open ends whereby one end aligns with the open end of the barrel the cylinder being disposed between the carriage and the top strap; and a cylinder lock pin assembled to the carriage and operable between two positions, a first position releases the cylinder to enable the cylinder to rotate open for loading.

3. The firearm sub frame of claim 2 further comprising:

a hammer having a hammer-mounting pin inserted in a hammer-mounting hole located on the carriage;

a hammer-block plate disposed in the carriage adjacent to the cylinder in a normally closed position whereby the plate positions intermediate to the cylinder and the hammer, the hammer-block plate further being mechanically coupled to the trigger assembly whereby operation of the trigger assembly in the fire position pulls the hammer-block plate by means of a biasing member away from the hammer.

4. The foldable survival tool of claim 1 wherein the handle portion further comprises:

at least one hollow interior portion adapted to receive at least one foldable tool, wherein the at least one foldable tool couples to a tool-pivot member that enables the at least one foldable tool to substantially reside inside the hollow interior portion in a first, closed position and selectively open to a second, extended position, the use-position; the tool-pivot member further comprising a tool-locking means for retaining the at least one foldable tool in the extended position.

5. The foldable survival tool of claim 4 wherein:

the at least one foldable tool comprises any combination of a short-blade, a long-blade, a serrated blade, a scissors, a file, or a curved blade.

6. The foldable survival tool of claim 1 wherein:

the handle portion further comprises a glass-breaker.

7. The foldable survival tool of claim 1 wherein the pivot element further comprises:

a ratchet rack disposed in the firearm sub-frame and adapted to enable the handle portion to pivot on a variable radius relative to the sub-frame thus encapsulating a portion of the firearm sub-frame enabling the tool to fold in a compact position yet leaving a portion of the handle for other; the rack further including at least one flat springs to enable the firearm to be compact and fold against the handle portion.

8. The foldable survival tool of claim 1 further comprising:

a key lock assembly adapted to fit within a portion of the handle portion, the key lock assembly comprising a key plate with a keyed opening, the key plate arranged on an exterior face of the handle so that when the handle is in the folded position the key opening is exposed enabling selective locking of the key lock assembly from a locked position to an unlocked position;

a rotatable shaft having a first end coupled to the lock plate;

a locking plate coupled to a second end of the shaft, the locking plate adapted to selectively engage a portion of the fire-arm sub-plate when in the folded and locked positions.

9. The foldable survival tool of claim 1 further comprising:

a dual laser sighting mechanism coupled to the firearm sub-frame, the dual laser mechanism comprising a laser holder having a red first laser inserted in a first opening on the holder, and a green second laser arranged in a second opening on the holder.

10. An improved foldable sidearm comprising:

a frame member comprising a handle-portion, a pivot element, and a firearm sub frame wherein the handle-portion selectively rotates with respect to the firearm sub frame by means of the pivot element, the handle-portion further being adapted to receive a portion of the firearm sub frame when the frame member is in a first, folded position, the frame member further being operable in a second, open position;

the firearm sub frame further comprising a carriage and a foldable trigger assembly coupled to the carriage, the trigger assembly being operable in at least two positions including a folded position, and a firing-ready position;

the foldable trigger assembly further comprising a forked trigger comprising a base and two upward reaching arms, a trigger pin mounting through hole is disposed at each respective distal end of each arm, a safety lever disposed intermediate to the two arms, the safety lever having a trigger pin mounting hole aligned with the trigger pin mounting through holes of the two arms, and a trigger pin mounted to the carriage, the trigger pin suspending the forked trigger and safety lever at each respective trigger pin mounting hole to the carriage, the trigger pin further being operable to enable the forked trigger and safety lever to fold forward and upwards from a near vertical, operable position to a horizontal, closed position.

11. The foldable sidearm of claim 10 wherein the fire-arm sub frame further comprises:

a carriage consisting of a generally rectilinear cross section when viewed from the front and, in profile, resembles a square-U-shape with an open top portion;

a press-fit top portion coupled to a top portion of the carriage, the top-portion including a dovetail feature;

a top strap adapted to mate with the dovetail feature of the top strap and couple to the top strap;

a barrel coupled to a front portion of the carriage, the barrel including a hollow cylindrical passage having two opposite and linearly aligned open ends one end being coupled to the carriage;

a cylinder aligned with the barrel, the cylinder being rotatably mounted to the carriage, the cylinder including at least one chamber, the at least one chamber having two oppositely disposed open ends whereby one end aligns with the open end of the barrel the cylinder being disposed between the carriage and the top strap; and a cylinder lock pin assembled to the carriage and operable between two positions, a first position releases the cylinder to enable the cylinder to rotate open for loading.

12. The firearm sub frame of claim 11 further comprising:

a hammer having a hammer-mounting pin inserted in a hammer-mounting hole located on the carriage;

a hammer-block plate disposed in the carriage adjacent to the cylinder in a normally closed position whereby the plate positions intermediate to the cylinder and the hammer, the hammer-block plate further being mechanically coupled to the trigger assembly whereby operation of the trigger assembly in the fire position pulls the hammer-block plate by means of a biasing member away from the hammer.

13. The foldable sidearm of claim 10 wherein the pivot element further comprises:

a ratchet rack disposed in the firearm sub-frame and adapted to enable the handle portion to pivot on a variable radius relative to the sub-frame thus encapsulating a portion of the firearm sub-frame enabling the tool to fold in a compact position yet leaving a portion of the handle for other; the rack further including at least one flat springs to enable the firearm to be compact and fold against the handle portion.

14. The foldable sidearm of claim 10 further comprising:

a key lock assembly adapted to fit within a portion of the handle portion, the key lock assembly comprising a key plate with a keyed opening, the key plate arranged on an exterior face of the handle so that when the handle is in the folded position the key opening is exposed enabling selective locking of the key lock assembly from a locked position to an unlocked position;

a rotatable shaft having a first end coupled to the lock plate;

a locking plate coupled to a second end of the shaft, the locking plate adapted to selectively engage a portion of the fire-arm sub-plate when in the folded and locked positions.

15. A method comprising:

providing a handle-portion;

providing a pivot element;

providing a firearm sub frame;

assembling the handle-portion to the firearm sub frame by means of the pivot element to create a foldable frame member wherein the handle-portion selectively rotates with respect to the firearm sub frame by means of the pivot element, and wherein the handle-portion further being adapted to receive a portion of the firearm sub frame when the frame member is in a first, folded position, and wherein the frame member further being operable in a second, open position;

providing a foldable trigger assembly coupled to the firearm sub frame, the trigger assembly being operable in at least two positions including a a folded position, and a firing-ready position, and wherein the foldable trigger assembly further comprises a forked trigger comprising a base and two upward reaching arms, a trigger pin mounting through hole is disposed at each respective distal end of each arm, a safety lever disposed intermediate to the two arms, the safety lever having a trigger pin mounting hole aligned with the trigger pin mounting through holes of the two arms, and a trigger pin mounted to the carriage, the trigger pin suspending the forked trigger and safety lever at each respective trigger pin mounting hole to the carriage, the trigger pin further being operable to enable the forked trigger and safety lever to fold forward and upwards from a near vertical, operable position to a horizontal, closed position; and assembling the foldable trigger assembly to the firearm sub frame.

16. The method of claim 15 further comprising:

providing a dual laser sighting mechanism comprising a laser holder having a red first laser inserted in a first opening arranged on the on the holder, and a green second laser arranged in a second opening on the holder;

coupling the dual laser sighting mechanism to the foldable frame.

17. The method of claim 15 further comprising:

providing the pivot element further comprising a ratchet rack disposed in the firearm sub-frame and adapted to enable the handle portion to pivot on a variable radius relative to the sub-frame thus encapsulating a portion of the firearm sub-frame enabling the tool to fold in a compact position yet leaving a portion of the handle for other; the rack further including at least one flat springs to enable the firearm to be compact and fold against the handle portion.

18. The method of claim 15 further comprising:

providing a key lock assembly adapted to fit within a portion of the handle portion, the key lock assembly comprising a key plate with a keyed opening, the key plate arranged on an exterior face of the handle so that when the handle is in the folded position the key opening is exposed enabling selective locking of the key lock assembly from a locked position to an unlocked position;

a rotatable shaft having a first end coupled to the lock plate; a locking plate coupled to a second end of the shaft, the locking plate adapted to selectively engage a portion of the fire-arm sub-plate when in the folded and locked positions.

* * * * *